US010219583B2

(12) United States Patent
Dallas

(10) Patent No.: US 10,219,583 B2
(45) Date of Patent: Mar. 5, 2019

(54) FOOTWEAR WITH GROUND CONFORMING SUPPORTIVE CHASSIS

(71) Applicant: RED WING SHOE COMPANY, INC., Red Wing, MN (US)

(72) Inventor: Jason Dallas, Ellsworth, WI (US)

(73) Assignee: RED WING SHOE COMPANY, INC., Red Wing, MN (US)

( * ) Notice: Subject to any disclaimer, the term of this patent is extended or adjusted under 35 U.S.C. 154(b) by 88 days.

(21) Appl. No.: 15/336,198

(22) Filed: Oct. 27, 2016

(65) Prior Publication Data

US 2018/0116336 A1 May 3, 2018

(51) Int. Cl.

| | |
|---|---|
| ***A43B 13/12*** | (2006.01) |
| ***A43B 13/18*** | (2006.01) |
| ***A43B 13/04*** | (2006.01) |
| ***A43B 13/22*** | (2006.01) |
| ***A43B 13/14*** | (2006.01) |

(52) U.S. Cl.

CPC ..... *A43B 13/186* (2013.01); *A43B 13/04* (2013.01); *A43B 13/12* (2013.01); *A43B 13/122* (2013.01); *A43B 13/14* (2013.01); *A43B 13/18* (2013.01); *A43B 13/188* (2013.01); *A43B 13/223* (2013.01)

(58) Field of Classification Search

CPC ..... A43B 13/02; A43B 13/04; A43B 13/12; A43B 13/125; A43B 13/127; A43B 13/18; A43B 13/186; A43B 13/188

USPC ..... 36/25 R, 30 R, 31, 30 A, 37

See application file for complete search history.

(56) References Cited

U.S. PATENT DOCUMENTS

| | | | | |
|---|---|---|---|---|
| 4,219,945 A * | 9/1980 | Rudy | A43B 13/203 36/29 |
| 4,271,606 A * | 6/1981 | Rudy | A43B 13/223 36/29 |
| 6,038,790 A * | 3/2000 | Pyle | A43B 7/1425 36/28 |
| 6,412,196 B1 * | 7/2002 | Gross | A43B 13/026 36/102 |
| 6,802,138 B2 * | 10/2004 | McManus | A43B 7/144 36/17 R |
| 7,200,955 B2 * | 4/2007 | Foxen | A43B 7/1425 36/25 R |
| 2003/0029060 A1 * | 2/2003 | Hockerson | A43B 5/02 36/67 R |

(Continued)

*Primary Examiner* — Marie D Bays
(74) *Attorney, Agent, or Firm* — Merchant & Gould P.C.

(57) ABSTRACT

The present disclosure provides footwear designs and related methods of manufacturing footwear. Certain embodiments of the footwear are particularly well suited for use traversing steep rocky uneven terrain. The footwear provides the user's foot support over steep and uneven terrain, underfoot rock protection, shock attenuation, and maximum traction.

10 Footwear
12 upper
14 sole assembly
16 outsole
18 midsole
20 chassis
22 adaptive heel component
24 adaptive forefoot component
26 heel portion of outsole
28 forefoot portion of outsole
30 arch portion of outsole
32 heel portion of midsole
34 forefoot portion of midsole
36 arch portion of midsole
38 heel stabilizer of chassis (Continued)

40 forefoot platform of chassis
42 arch portion of chassis
44,46 lugs
48 heel striker
50 outside wall of heel stabilizer of chassis
52 inside wall of heel stabilizer of chassis
54 open rear portion of heel stabilizer of chassis
56, 58 windows in the outsole

14 Claims, 9 Drawing Sheets

(56) References Cited

U.S. PATENT DOCUMENTS

| | | | | |
|---|---|---|---|---|
| 2004/0154188 | A1* | 8/2004 | Laska | A43B 5/06 36/25 R |
| 2005/0268490 | A1* | 12/2005 | Foxen | A43B 7/1425 36/28 |
| 2006/0191163 | A1* | 8/2006 | Nakano | A43B 7/144 36/30 R |
| 2010/0307028 | A1* | 12/2010 | Teteriatnikov | A43B 13/127 36/108 |
| 2013/0199054 | A1* | 8/2013 | Litchfield | A43B 13/12 36/28 |
| 2017/0251753 | A1* | 9/2017 | Meschter | A43B 13/04 |

* cited by examiner

FOOTWEAR WITH GROUND CONFORMING SUPPORTIVE CHASSIS

BACKGROUND

A stiff sole construction is often employed in footwear designed for traversing steep rocky uneven terrain. The stiff sole construction provides support and minimizes foot fatigue. However, since the sole is stiff, often only a portion of the tread on the outsole is engaged with the ground surface, which is undesirable as it limits traction. Also, the stiff sole construction can result in footwear that does not include sufficient shock attenuation. Accordingly, there is a need in the art for improved footwear for traversing steep rocky uneven terrain.

SUMMARY

The present disclosure provides footwear designs and related methods of manufacturing footwear. Certain embodiments of the footwear are particularly well suited for use traversing steep rocky uneven terrain. The footwear provides the user's foot support over steep and uneven terrain, underfoot rock protection, shock attenuation, and maximum traction.

DETAILED DESCRIPTION

Figure 1:
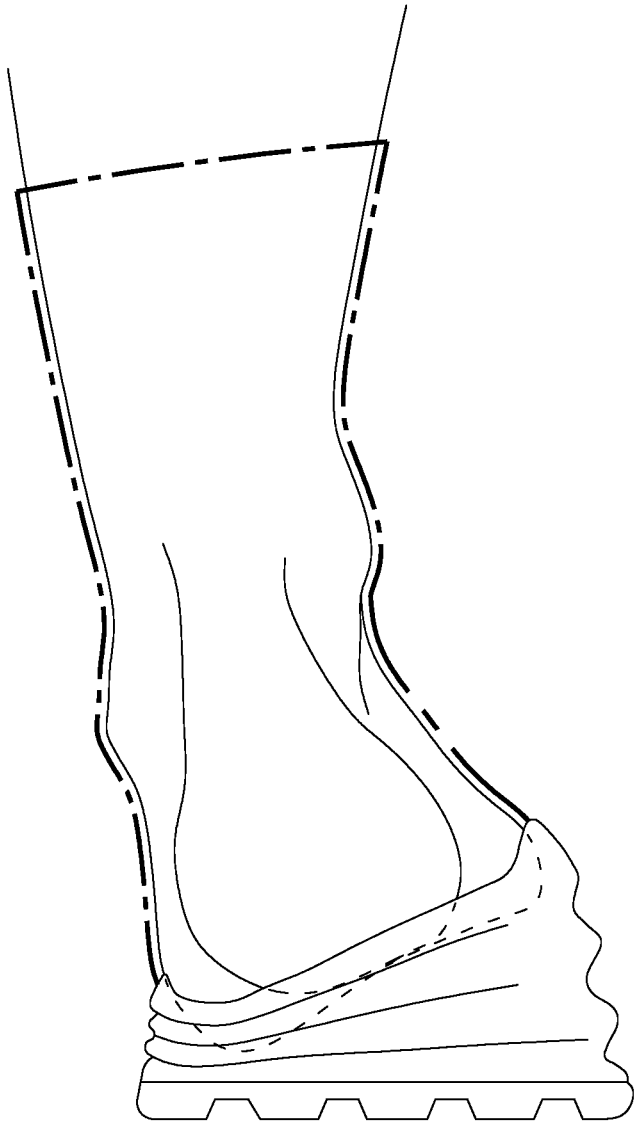
FIG. 1 (PRIOR ART)
FIG. 1 is rear illustration of a prior art configuration.
Figure 2:
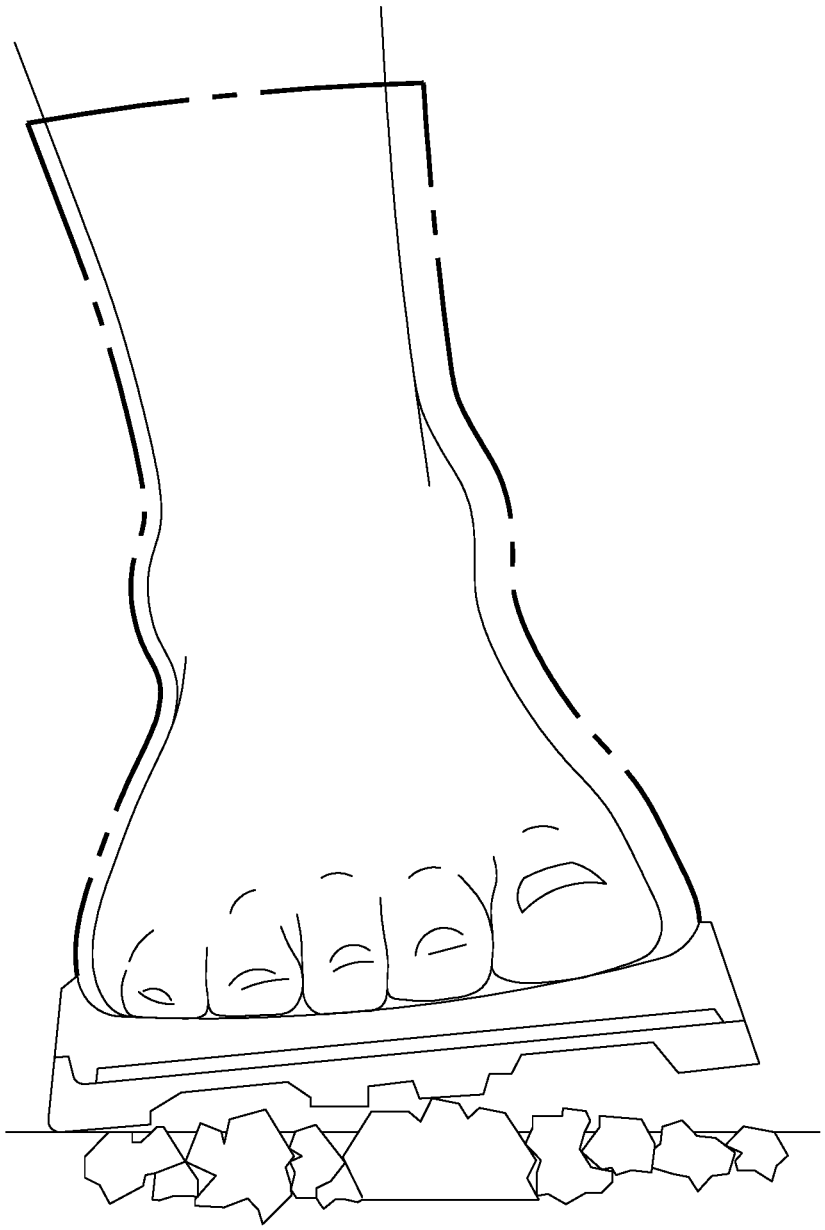
FIG. 2 (PRIOR ART)
FIG. 2 is a front illustration of prior art configuration on rocky terrain.
Figure 3:
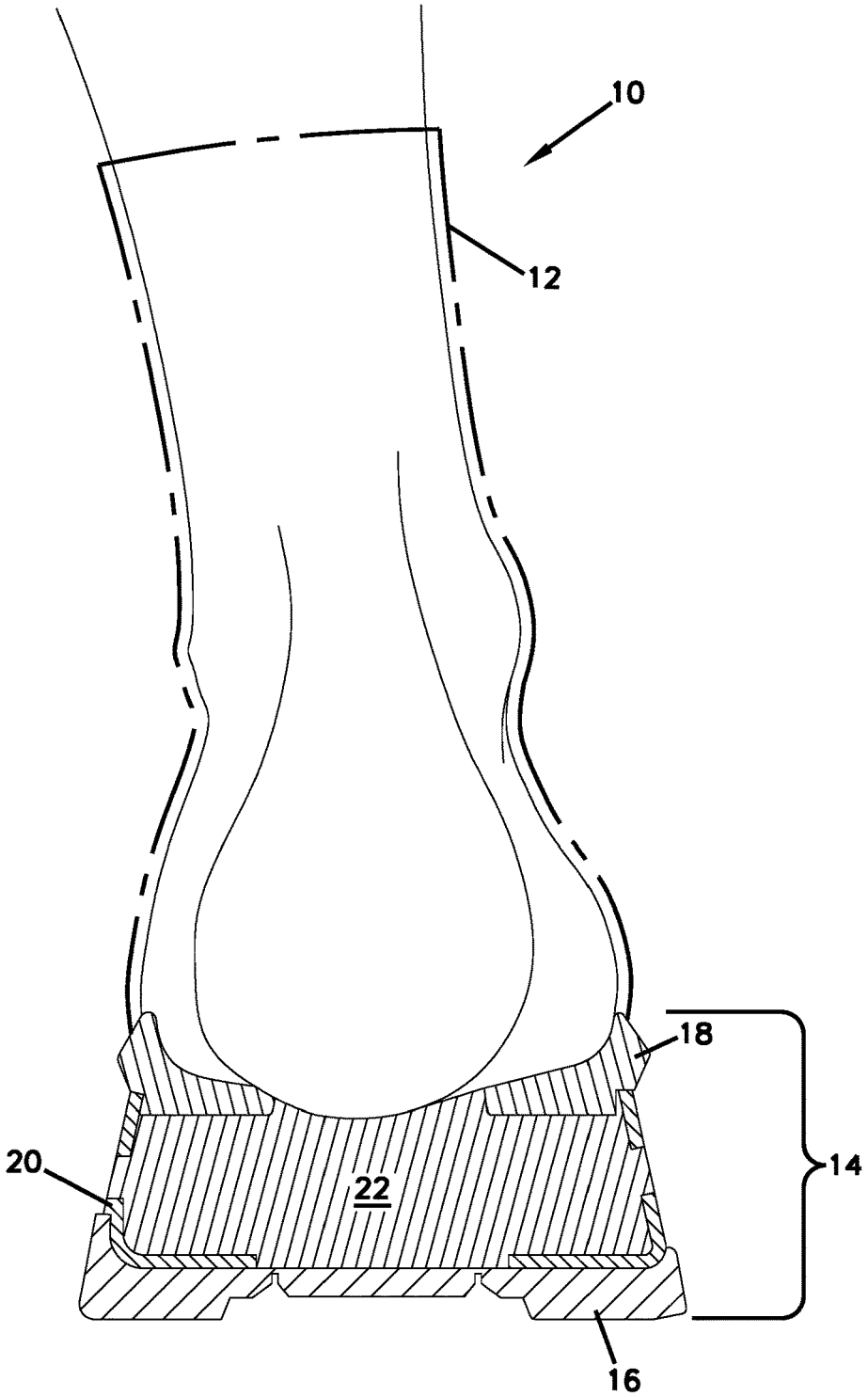
FIG. 3 is a rear illustration of footwear according to the present disclosure.
Figure 4:
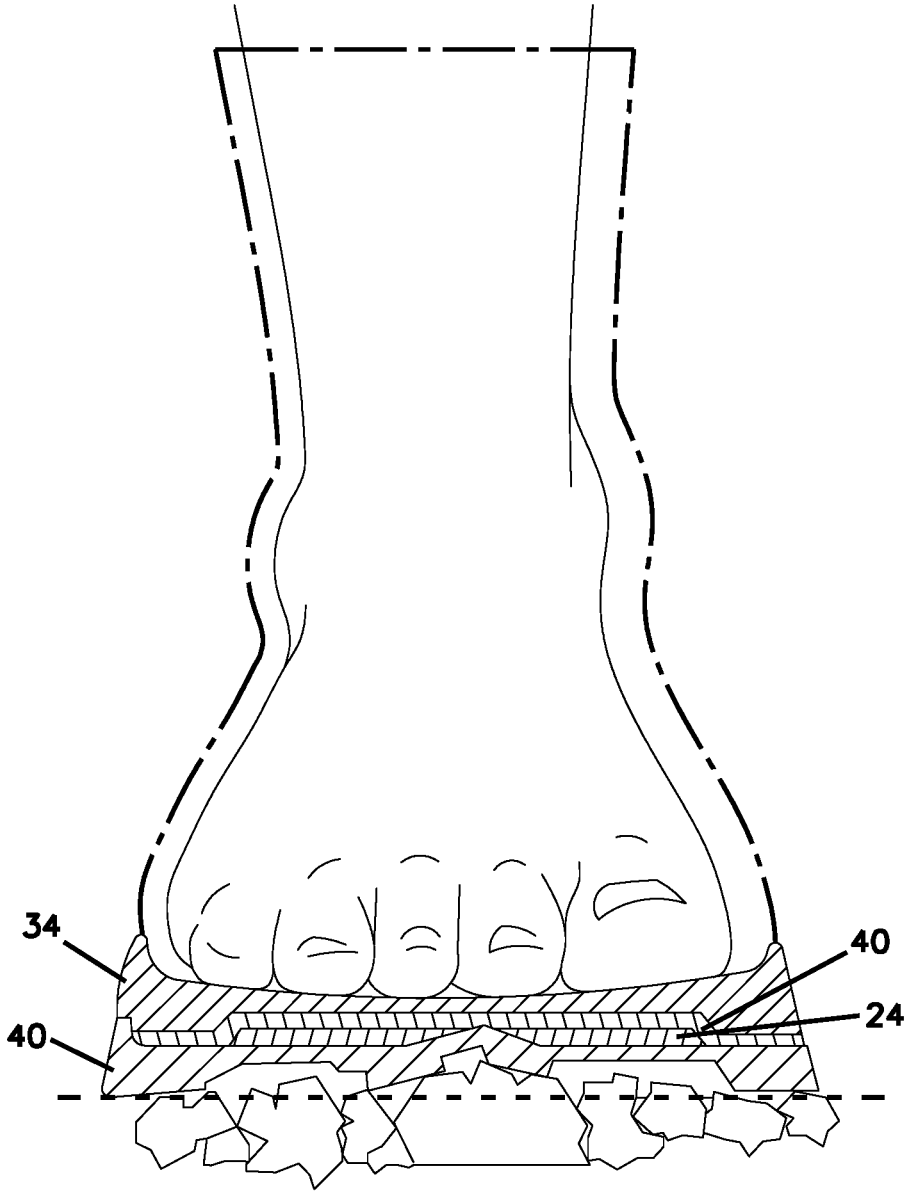
FIG. 4 is a front illustration of the footwear of FIG. 3 on rocky terrain.
Figure 5:
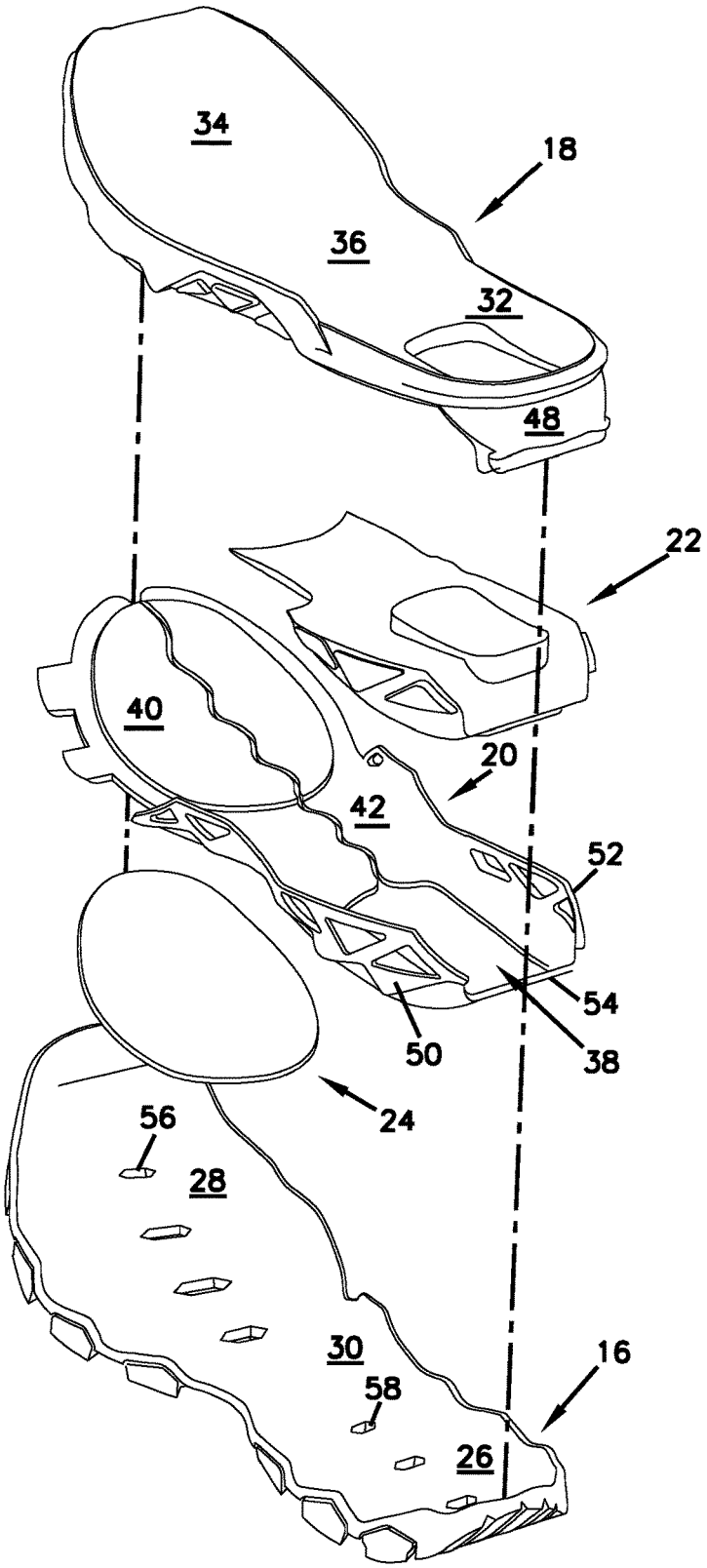
FIG. 5 is a rear top exploded perspective view of the footwear of FIG. 3.
Figure 6:
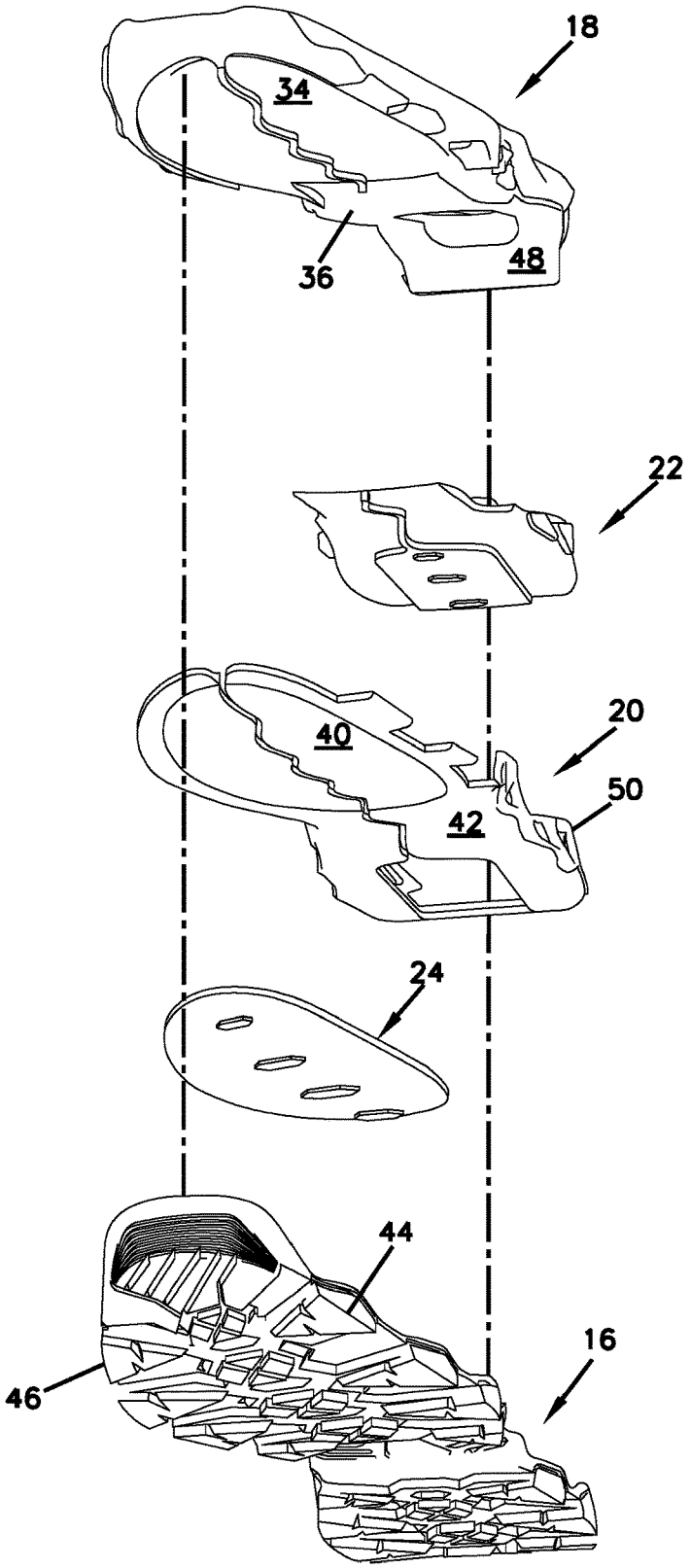
FIG. 6 is a front bottom exploded perspective view of the footwear of FIG. 3.
Figure 7:
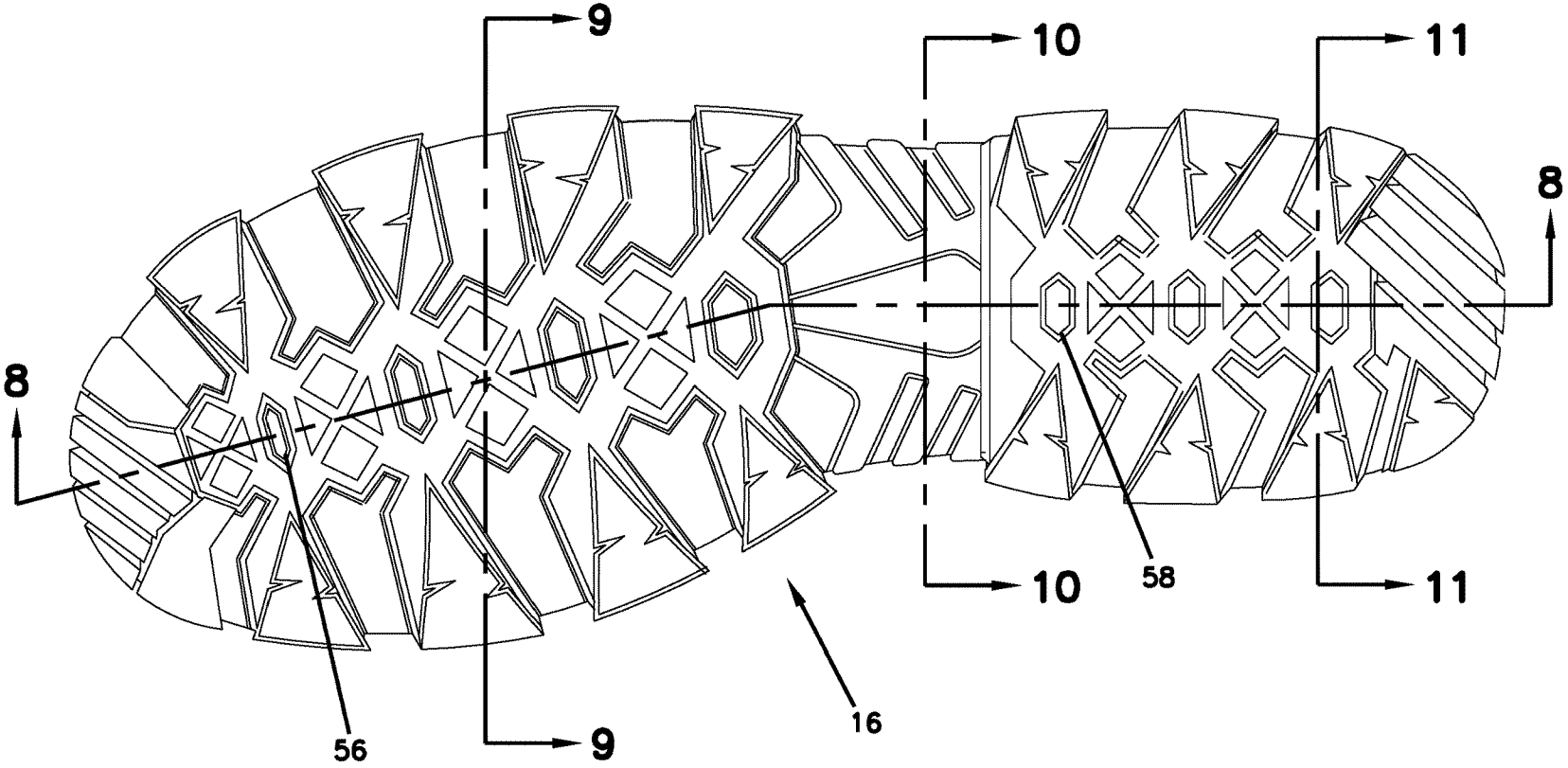
FIG. 7 is a bottom view of the footwear of FIG. 3.
Figure 8:
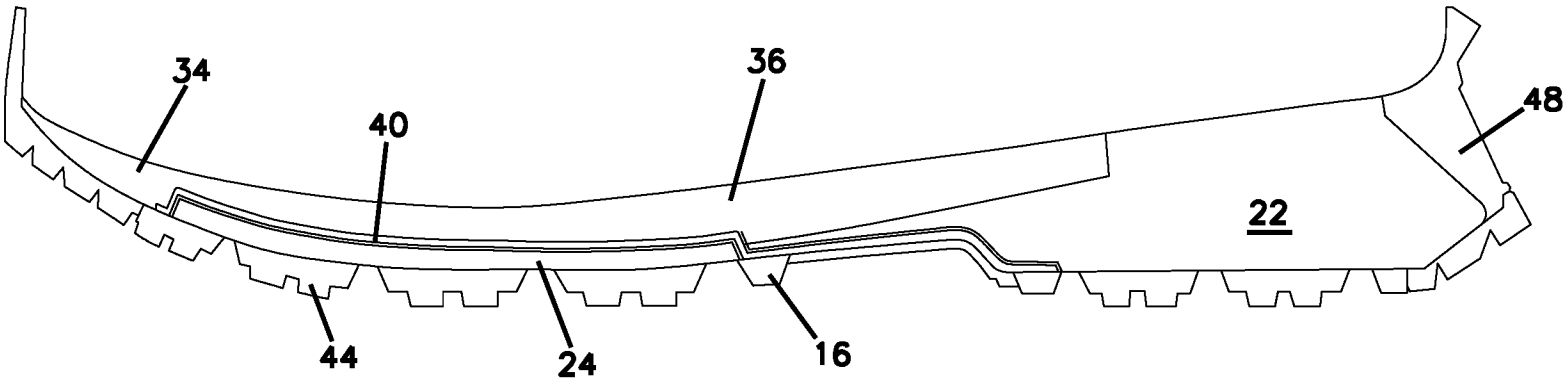
FIG. 8 is a cross sectional view of the footwear of FIG. 3 along line 8-8.
Figure 9:
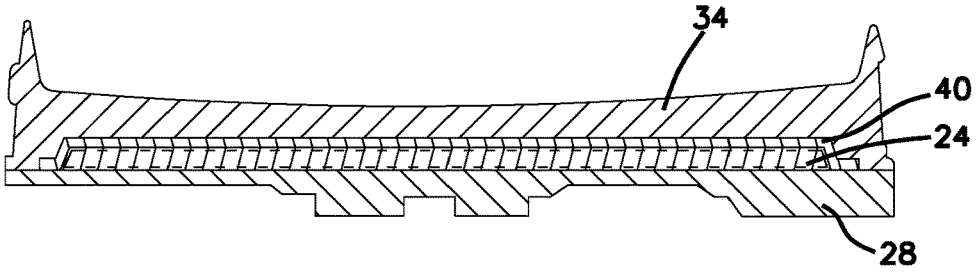
FIG. 9 is a cross sectional view of the footwear of FIG. 3 along line 9-9.
Figure 10:
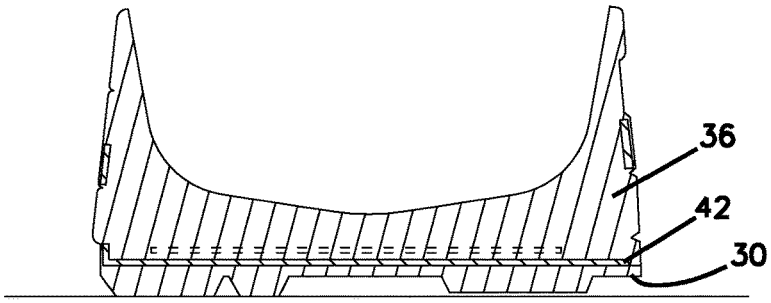
FIG. 10 is a cross sectional view of the footwear of FIG. 3 along line 10-10.
Figure 11:
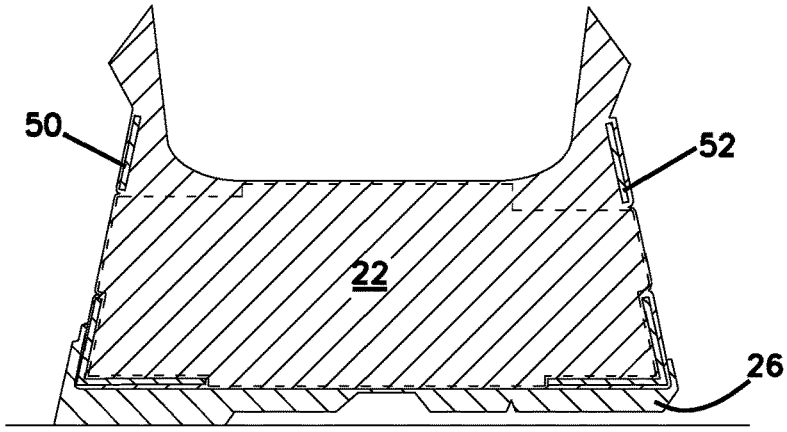
FIG. 11 is a cross sectional view of the footwear of FIG. 3 along line 11-11.

Referring to the figures generally, an embodiment of footwear according to principles of the present disclosure is described further herein. In the depicted embodiment, the footwear 10 includes an upper 12 connected to a sole assembly 14. In the depicted embodiment, the upper is of an over the ankle boot. However, it should be appreciated that the upper can have a number of alternative construction including, for example, a below the ankle shoe (e.g., an approach shoe). In the depicted embodiment, the sole assembly 14 includes an outsole 16, a midsole 18, a chassis 20, an adaptive heel component 22, and an adaptive forefoot component 24. It should be appreciated that many other configurations are also possible. In other embodiments, the sole can include more or less components.

In the depicted embodiment, the outsole 16 includes a heel portion 26, a forefoot portion 28, and an arch portion

30. The arch portion 30 is located between the heel portion 26 and the forefoot portion 28. In the depicted embodiment, the outsole 16 is rubber having a thickness between 1.0 mm to 2.25 mm. In the depicted embodiment, the lugs 44, 46 are tiered lugs. In the depicted embodiment, the outsole include windows 56, 58 that expose the adaptive heel component 22 and the adaptive forefoot component 24. It should be appreciated that many alternative embodiments are possible. For example, in an alternative embodiment, the outsole can be constructed such the heel portion and the forefoot portion are not connected (e.g., no arch portion). Also, it should be appreciated that the lugs/tread can be different than shown and the outsole need not be rubber or have the dimensions referred to above.

In the depicted embodiment, the midsole 18 includes a heel portion 32, a forefoot portion 34, and an arch portion 36. The arch portion 36 connects the heel portion 32 to the forefoot portion 34. In the depicted embodiment, the heel portion 32 of the midsole 18 includes a downwardly extending heel striker 48 that abuts the outsole 16. It should be appreciated that many alternative embodiments are possible. For example, in an alternative embodiment, the midsole does not include a heel striker. In other alternative embodiments, the midsole can include a number of other components.

In the depicted embodiment, the chassis 20 includes a heel stabilizer 38, a forefoot platform 40, and an arch portion 42. The arch portion 42 connects the heel stabilizer 38 to the forefoot platform 40. In the depicted embodiment, the heel stabilizer 38 includes opposed upwardly extending inside and outside walls 50, 52 and an open rear portion 54. In the depicted embodiment, the chassis 20 is formed of a thermoplastic polyurethane (TPU). In the depicted embodiment, the forefoot platform extends to the front periphery zone and side periphery zone of the forefoot portion of the footwear. It should be appreciated that many alternative embodiments are possible. For example, in an alternative embodiment, the chassis include multiple components that are not directly connected to each other. In other alternative embodiment, the chassis include a narrower flat shank in the arch portion as compared to what is illustrated. Likewise in alternative embodiments, forefoot platforms and heel stabilizers can either be absent or have a different construction.

In the depicted embodiment, the adaptive heel component 22 extends from the heel portion 26 of the outsole 16 upwardly through the heel stabilizer 38 of the chassis 20 and through the heel portion 32 of the midsole 18. In the depicted embodiment, the adaptive heel component 22 extends between the opposed side walls 50, 52 of the chassis 20. In the depicted embodiment, the adaptive heel component 22 is located forward of a heel striker 48. In the depicted embodiment, the heel striker is part of the midsole and has a greater firmness than the adaptive heel component 22. It should be appreciated that many alternative embodiments are possible. For example, the adaptive heel component can, for example, extend all the way to the rear of the footwear and could stop short of the top of midsole.

In the depicted embodiment, the adaptive forefoot component 24 is located between the forefoot portion 28 of the outsole 16 and the forefoot platform 40 of the chassis 20. In the depicted embodiment, the adaptive forefoot component is between 1.0-5.0 mm thick. It should be appreciated that many alternative embodiments are possible. For example, the adaptive forefoot component could in an alternative embodiment stop short of the periphery of the footwear or tapper towards the periphery. The adaptive forefoot component can have a number of different constructions.

In the depicted embodiment, the adaptive heel component 22 and the adaptive forefoot component 24 are formed from a material having a greater rebound than the midsole material. In the depicted embodiment, the midsole 18 is formed of an ethylene-vinyl acetate (EVA). In the depicted embodiment, the adaptive heel component 22 and the adaptive forefoot component 24 are constructed of the same material. In the depicted embodiment, the adaptive heel component 22 and the adaptive forefoot component 24 are constructed of a material having both high rebound (e.g., a material having between 42-48 percent rebound as compared to 40 percent rebound for common EVA) and low compression (e.g., a material having 25-35 percent compression as compared to 60 percent for common EVA and 25-28 percent common polyurethane). In the depicted embodiment, the adaptive heel component is shaped to interlock with the chassis 20, midsole 18, and outsole 16. It should be appreciated that many alternative embodiments are possible. A number of different materials can be used to construct these components, and the materials in the adaptive forefoot component can be different than the material in the adaptive heel component.

The present disclosure also discloses a method of manufacturing footwear. In one embodiment, the method including the steps of providing an adaptive forefoot component 24 between the forefoot portion 28 of an outsole and a forefoot platform 40, wherein the adaptive forefoot component is formed of a material that is softer and/or have a greater rebound than the midsole material. The method also includes the step of providing an adaptive heel component 22 forward of the heel strike zone and between opposed side walls 50, 52 of a midsole 18. In the depicted embodiment, the method also includes the step of providing a chassis having side wall extending upwardly in the arch and heel zones. It should be appreciated that many alternative embodiments of the method are possible. Some of which include more steps and some of which include less steps.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

I claim:

1. A footwear comprising:

an upper;

a sole assembly connected to the upper, the sole assembly including:

an outsole, the outsole including a heel portion, a forefoot portion, and an arch portion, the arch portion being located between the heel portion and the forefoot portion;

a midsole, the midsole including a heel portion, a forefoot portion, and an arch portion, the arch portion connecting the heel portion to the forefoot portion;

a chassis including a heel stabilizer, a forefoot platform, and an arch portion, the arch portion connecting the heel stabilizer to the forefoot platform;

an adaptive heel component that extends from the heel portion of the outsole upwardly through the heel stabilizer of the chassis and through the heel portion of the midsole; and an adaptive forefoot component located between the forefoot portion of the outsole and the forefoot platform of the chassis.

2. The footwear of claim 1, wherein the adaptive heel component and the adaptive forefoot component are formed from a material having a greater rebound than material of the midsole that is formed of an ethylene-vinyl acetate (EVA).

3. The footwear of claim 1, wherein the outsole is rubber having a thickness between lugs of between 1.0 mm to 2.25 mm.

4. The footwear of claim 1, wherein the heel portion of the midsole includes a downwardly extending heel striker that abuts the outsole.

5. The footwear of claim 1, wherein the heel stabilizer includes opposed inside and outside walls and an open rear portion.

6. The footwear of claim 1, wherein the chassis is formed of a thermoplastic polyurethane (TPU).

7. The footwear of claim 1, wherein the adaptive heel component interlocks with the chassis, midsole, and outsole.

8. The footwear of claim 1, wherein the outsole includes tiered lugs.

9. The footwear of claim 1, wherein the outsole includes windows that expose the adaptive heel component and the adaptive forefoot component.

10. A footwear comprising:

an upper;

a sole assembly connected to the upper, the sole assembly including:

an outsole, the outsole including a heel portion, a forefoot portion, and an arch portion, the arch portion being located between the heel portion and the forefoot portion, the outsole including a rubber backing with lugs thereon, the rubber backing having portions that are between 1.0 mm to 2.0 mm thick;

a midsole, the midsole including a heel portion, a forefoot portion, and an arch portion, the arch portion being located between the heel portion and the forefoot portion, the midsole being constructed of ethylene-vinyl acetate (EVA);

a chassis, the chassis including a heel stabilizer, a forefoot platform, and an arch portion, the arch portion being located between the heel stabilizer and the forefoot platform, the heel stabilizer including upwardly extending opposed side walls;

an adaptive heel component that extends from the heel portion of the outsole upwardly between the opposed side walls of the chassis, the adaptive heel component having a rebound that is greater than a rebound of the midsole; and an adaptive forefoot component being located between the forefoot portion of the outsole and the forefoot platform of the chassis, the adaptive forefoot component having a rebound that is greater than the rebound of the midsole.

11. The footwear of claim 10, wherein the adaptive heel component is located forward of a heel striker, wherein the heel striker has greater firmness than the adaptive heel component.

12. The footwear of claim 10, wherein the adaptive heel component and the adaptive forefoot component are formed from a material having a greater rebound than material of the midsole that is formed of an ethylene-vinyl acetate (EVA).

13. The footwear of claim 10, wherein at least a portion of the adaptive forefoot component is between 1.0-5.0 mm thick.

14. The footwear of claim 10, wherein the forefoot platform extends to a front periphery zone and side periphery zone of the forefoot portions of the footwear.

* * * * *